United States Patent [19]

Dearman

[11] Patent Number: 4,615,574

[45] Date of Patent: Oct. 7, 1986

[54] DEVICE FOR TERMINATING AN ELECTRICAL CABLE

[75] Inventor: Kenneth W. J. Dearman, Slough, United Kingdom

[73] Assignee: Icore International Limited, Slough, United Kingdom

[21] Appl. No.: 713,902

[22] PCT Filed: Jul. 19, 1984

[86] PCT No.: PCT/GB84/00257

§ 371 Date: Mar. 18, 1985

§ 102(e) Date: Mar. 18, 1985

[87] PCT Pub. No.: WO85/00701

PCT Pub. Date: Feb. 14, 1985

[30] Foreign Application Priority Data

Jul. 20, 1983 [GB] United Kingdom ..... 8319630

[51] Int. Cl.[4] ..... H01R 11/00

[52] U.S. Cl. ..... 339/61 C; 339/177 R; 339/143 R; 339/213 R

[58] Field of Search ..... 339/59–63, 339/94, 177, 201, 213 R, 103 R, 103 M, 15, 16, 177 R, 177 E

[56] References Cited

U.S. PATENT DOCUMENTS

| | | | |
|---|---|---|---|
| 2,501,674 | 3/1950 | Graham | 339/60 R |
| 2,755,449 | 7/1956 | Anderson | 339/59 R |
| 3,347,566 | 10/1967 | Nelson | 339/16 R |
| 3,624,595 | 11/1971 | Severin | 339/201 |
| 3,742,426 | 6/1973 | Huber et al. | 339/213 R |
| 4,325,600 | 4/1982 | Nestor | 339/94 M |

*Primary Examiner*—Gil Weidenfeld
*Assistant Examiner*—David L. Pirlot

[57] ABSTRACT

A device (1) comprising a flexible and resilient sleeve (2) made of rubber, rubber-like, plastics or similar material and a metal end termination (3) which has a screw thread connection with an electrical component (4) in the form of a multi-pin connector or plug. The end termination (3) has an interface (5) for conductors or wires of the multi-core cable and a body (6) which has a tapered entry (7) in which is received the sleeve (2) and metal braids (8) which screen the cable (9). There is a seal in the form of an O-ring (10) at the blind end of the entry (7) to prevent moisture getting into the cable. The other end of the sleeve (2) from the body (6) is mechanically secured as by adhesive to the other surface of an outer sheath of the multi-core cable (9) at anchor (11). To re-enter connection, the termination (3) and component (4) are unscrewed and pulled apart in direction (x) so that the convulsions of the sleeve (2) bunch up. An embodiment is described in which a metallic screen is independent of end termination (3) and is not retracted when the termination is retracted, the screen having a ring which has complementary mating engagement with the end termination.

10 Claims, 7 Drawing Figures

DEVICE FOR TERMINATING AN ELECTRICAL CABLE

TECHNICAL FIELD OF INVENTION

The invention relates to a device for terminating an electrical cable such as a multi-core electrical cable.

BACKGROUND ART

Electrical cables such as of the multi-core kind are often connected with electrical components such as multi-pin connectors. If a connection has to be modified or checked, it is usual not to be able to carry out such a task without destroying the interface and hence vitiating the integrity of the design characteristics of the connector.

DISCLOSURE OF INVENTION

It is an object of the invention to seek to mitigate this disadvantage.

According to the invention there is provided a device for terminating an electrical cable, comprising a flexible and resilient sleeve for securing to an outer surface of the cable and an end termination which is engageable with and disengeable from an electrical component to which the cable is to be connected, the arrangement being such that when the end termination is disengaged from the component the device can be retracted effectively by shortening the sleeve and withdrawing the end termination whereby to expose the cable connection.

Using the invention it is possible to provide an electrical connection which is re-enterable to enable rework to be carried out on an end termination interface.

The sleeve may be convoluted, preferably with helical convolutions, to enable the sleeve to be compressed axially when the device is retracted. This is a relatively simple yet efficient construction.

The end termination may have screw threads for engagement with a complementary screw thread of the electrical component. This construction is relatively simple yet provides for efficient engagement and disengagement.

The end termination may include a seal such as an "O"-ring. Such a seal protects the interior of the device against penetration by moisture, so obviating electrical short circuits.

The device may include means to bond mechanically with a metallic screen of the cable. This construction, particularly where the cable is a screened multi-core cable, provides for EMC screening through the end termination.

It will be understood that the invention extends to a cable including a device as hereinbefore defined.

Devices for terminating an electrical cable, embodying the invention, are hereinafter described, by way of example, with reference to the accompanying drawings.

Figure 1:
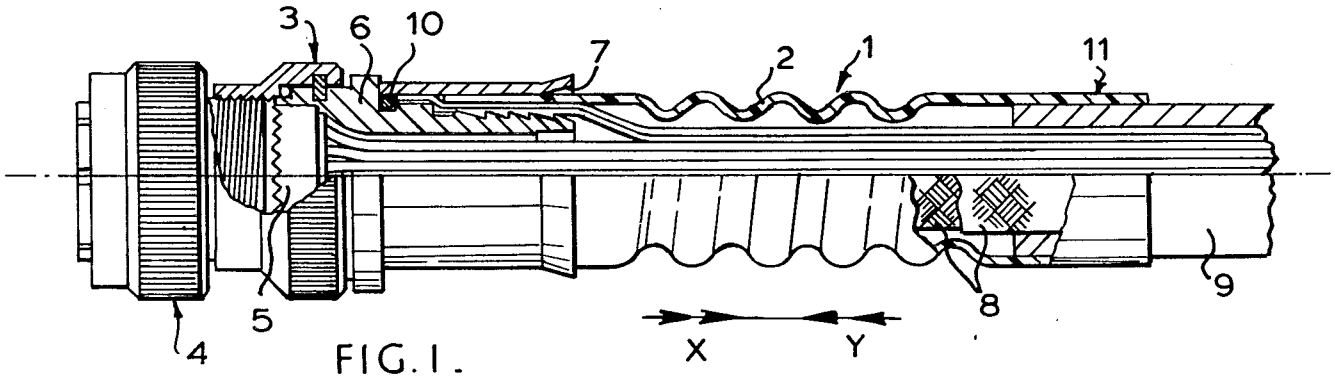
FIG. 1 is a part sectional view of a first device according to the invention mounted on the end of a multi-core electrical cable and connected with an electrical component in the form of a multi-pin connector.
Figure 2:
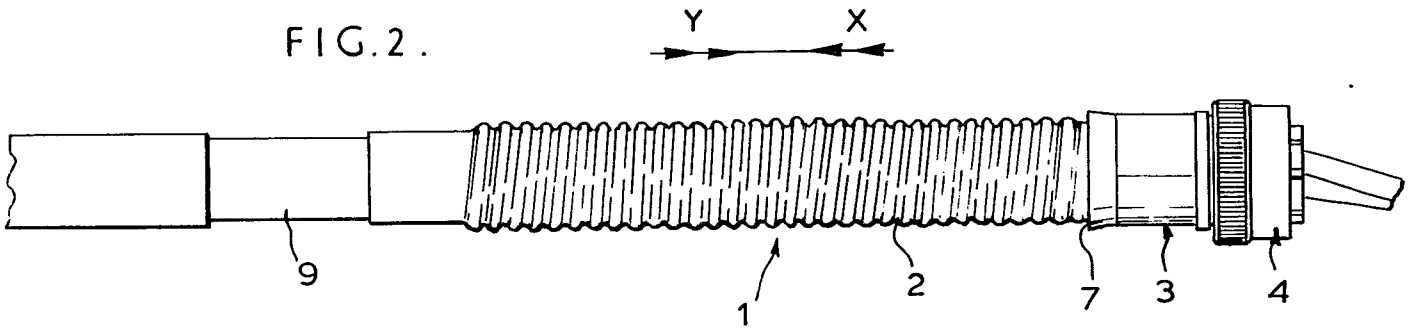
FIG. 2 is a view, to a smaller scale than that of FIG. 1, of the cable and device.

Referring to the drawings the device 1 shown comprises a flexible and resilient sleeve 2 made of rubber, rubber-like, plastics or similar material and a metal end termination 3 which has a screw thread connection with an electrical component 4 in the form of a multi-pin connector or plug. The end termination 3 has an interface 5 for conductors or wires of the multi-core cable and a body 6 which has a tapered entry 7 in which is received the sleeve 2 and metal braids 8 which screen the cable 9. There is a seal in the form of an "O"-ring 10 at the blind end of the entry 7 to prevent moisture getting into the cable. The other end of the sleeve 2 from the body 6 is mechanically secured as by adhesive to the outer surface of an outer sheath of the multi-core cable 9 at anchor 11.

In use, the sleeve 2 is secured as shown and the other end, with the braid, is drawn into the body 6 by screwing, so forming a firm mechanical bond over 360°, which ensures screening of the connection and the cores connected in the interface 5, itself mounted in the body 6. The end termination 3 is then screw engaged with the component 4 to make a complete device 1 embodying the invention. Should it be necessary to re-enter the connection to carry out further work thereon, the end termination 3 and component 4 are disengaged by unscrewing and by sliding the termination 3 to the right (as viewed in FIG. 1) which movement is accommodated by an axial compression and hence effective shortening of the sleeve 2, the sleeve being anchored on the cable at 11. When the rework has been completed, the end termination 3 is moved to the left (FIG. 1) and reconnected with the component 4. These respective movements are shown by the double-headed arrows "X" and "Y".

Figure 3:
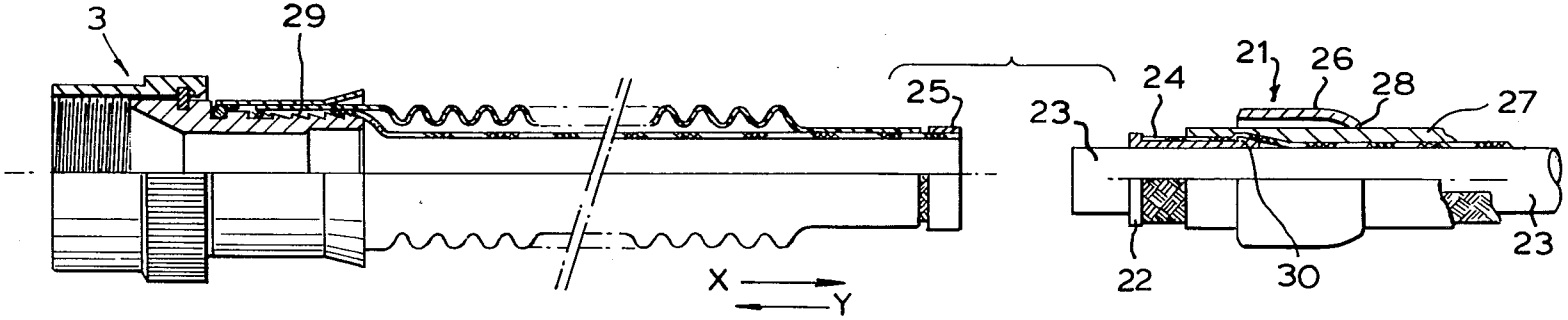
FIGS. 3 and 3A show, in part longitudinal section and enlarged relative to FIG. 1, a second embodiment of device according to the invention.
Figure 3A:
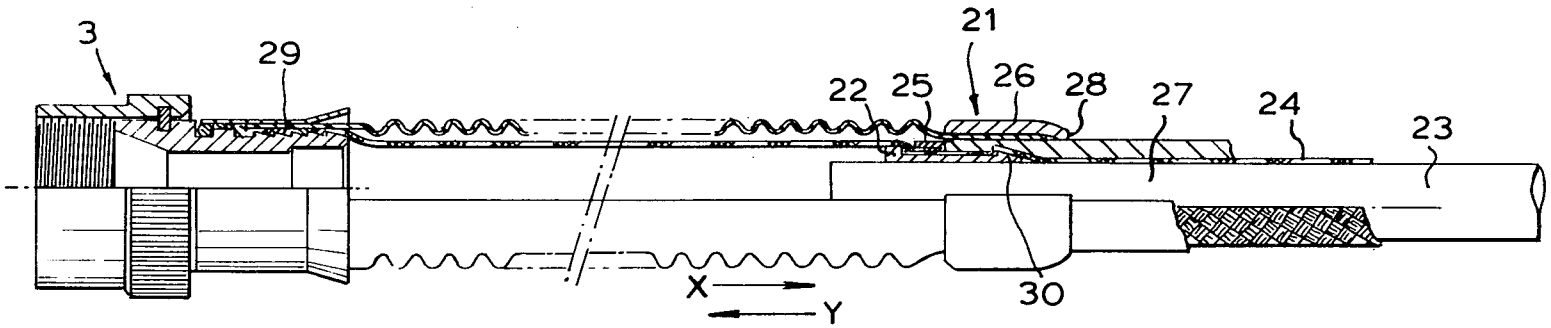

Referring now to FIGS. 3 and 3A, a second embodiment of device is shown, FIG. 3 showing anchor 21, the end termination 3 being identical to that shown in FIG. 1, the component 4 being omitted for clarity in FIGS. 3 and 3A. The anchor 21 comprises a support ring 22 for cable bundle conductors 23 and cable bundle screen(s) 24 a screen ring 25 and a metal sleeve 26 which is swaged down onto cable bundle outer sheath 27 at 28 to provide a firm connection of all the components which nevertheless are all fully screened.

In use, to re-enter the end termination provided by the device it is merely necessary as in the first embodiment, to unscrew the end termination from the connector 4 to expose the wires of the cable bundle after the end termination is retracted in the direction of the arrow "X". When the work is complete, the end termination is moved in the direction of the arrow "Y" to be screw connected with the connector, so that the device is complete and electrically screened and insulated once more ready for use. The convolution of the conduit allow this retraction and re-application.

Teeth 29 of body 6 in both embodiments ensure a positive grip or seating for braid or screen 24 at the end termination while tooth 30 has the same function at the securing end 21 of the end termination adjacent the sleeve 26.

Figure 4:
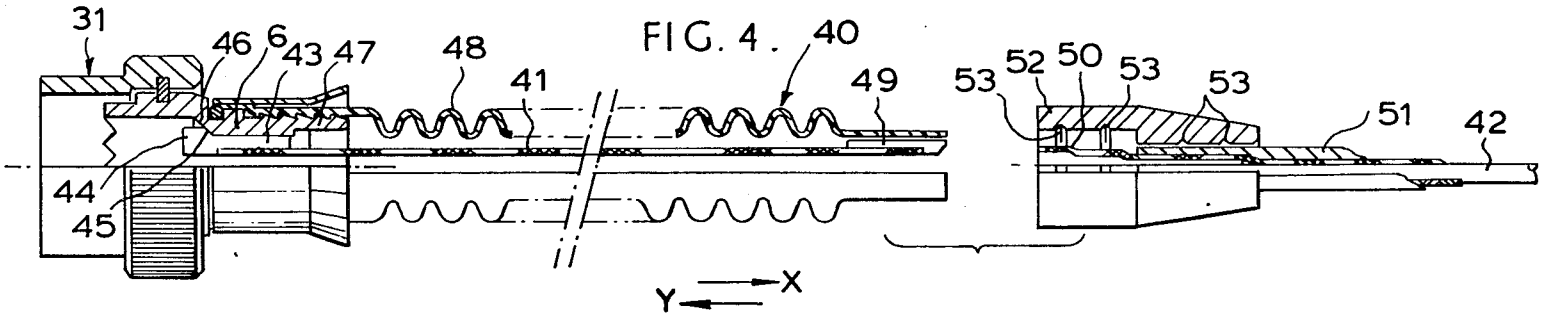
FIGS. 4 and 4A show, also in part longitudinal section and enlarged relative to FIG. 1, a third embodiment of device according to the invention.
Figure 4A:
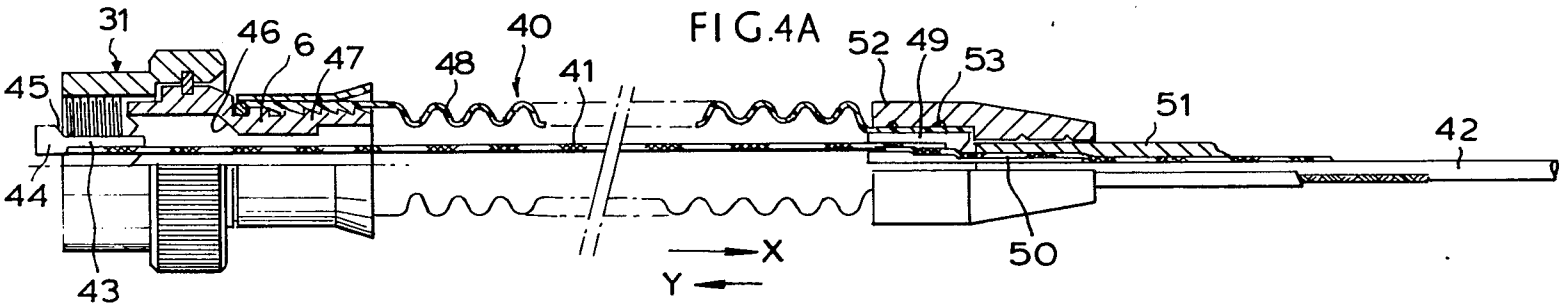

Referring to FIGS. 4 and 4A there is shown a third embodiment 40 of end termination 31. In this embodiment 40 there is an end termination 3 screw-engageable with a connector (not shown) as in the embodiments of FIGS. 1 and 3, 3A, but in this case a metal braid screen 41 of the device for the conductors/wires of the cable 42 is independent of the body 6. To achieve this, the screen 41 is secured to a screen ring 43 which has an enlarged head portion 44 which has a chamfered or inclined surface 45 which mates with a complementary surface 46 of the body 6, the surface 46 being internally of the body 6. The body 6 has teeth 47 by which the convoluted conduit 48 is firmly received in the body 6 of the device. At the other end of the device, the braid 41 is received in a screen ring 49 and overlies the braid or braids 50, the convoluted sleeve 48, screen ring 49, overlapping ends of the screen 41 and braid(s) 50 and outer sheath 51 of the cable 42 being firmly received in a metal sleeve 52 which is swaged down onto the outer sheath 51 to provide a secure fixing of all the components, which fixing is enhanced by circumferential notches or teeth 53 in the sleeve 42 so that when it is swaged down the convoluted conduit and outer sheath are forced into teeth to trap them and obviate withdrawal.

FIG. 4 shows the device as it is when the end termination 3 is screw-engaged with the component in which the conductors of the cable 42 are secured. The convolutions 48 are separate and the mating surfaces 45, 46 of the screen ring 44 and body 6 are in firm metal-to-metal contact so providing an integral screening (EMC) effect. When it is desired to re-enter the connection, the end termination 3 is unscrewed from the component and withdrawn to the right (as viewed) in the direction of arrow "X". The convolutions bunch up to allow such movement, but as the movement takes place, the body 6 is withdrawn from the screen ring 44 so that that ring 44 and the screen 41 to which it is attached stay where they are. They are thus "floating" or independent. This means that the conduit 48 can be withdrawn much further to the right because the screen 41 is not pulled back with it, and does not interfere with the retraction of the device and bunching up of the convolutions. This means that there is a much larger work length of the cable exposed for effecting the re-entry work. When it is desired to re-establish end termination after re-entry work has been completed the end termination 3 as moved to the left as viewed in the direction of arrow "Y" and is screw-engaged with the component, so completing the device. Movement back to the FIG. 4 position from the FIG. 4A position re-establishes firm metal-to-metal contact between the inclined mating surfaces 45 and 46 of the screen ring 44 and body 6.

Figure 5:
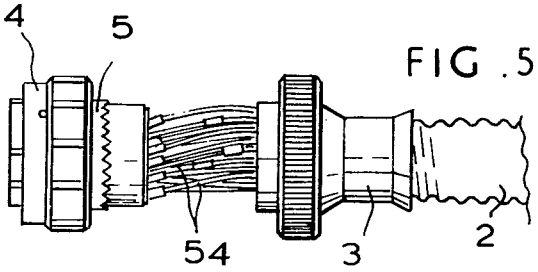
FIG. 5 shows a device according to the invention in use.

FIG. 5 shows schematically the manual retraction of the end termination fom the component or connector for access to the rear thereof to facilitate circuit repair or re-routing. The individual conductors 54 of the cable are shown, and the re-entrability provided by the devices enables cables to be re-routed or damaged ones to be repaired. Moreover, this re-entrability also allows for electrical checks such as DC resistance to be carried out.

In all cases full 360° EMC screening is obtained.

I claim:

1. A device for terminating an electrical cable, comprising a flexible and resilient sleeve for securing to an outer surface of the cable, and an end termination engageable with and disengageable from an electrical component to which the cable is to be connected, the arrangement being such that when the end termination is disengaged from the component the device can be retracted effectively by shortening the sleeve and withdrawing the end termination whereby to expose the cable connection, and tooth means of a hollow body which forms the end termination for effecting a mechanical bond with a metallic screen which screens the cable.

2. A device according to claim 1, the end termination having a screw thread for engagement with a complementary screw thread of the electrical component.

3. A device according to claim 1, the sleeve being convoluted.

4. A device according to claim 3, the convolutions being helical.

5. A device according to claim 1, the end termination including a seal whereby the interior of the device is protected from penetration by moisture.

6. A device according to claim 5, the seal comprising an "O"-ring.

7. A device for terminating an electrical cable, comprising a flexible and resilient sleeve for securing to an outer surface of the cable, and an end termination engageable with and disengageable from an electrical component to which the cable is to be connected, the arrangement being such that when the end termination is disengaged from the component the device can be retracted effectively by shortening the sleeve and withdrawing the end termination whereby to expose the cable connection, said device including a metallic screen secured at an end adjacent the end termination to a screen ring, the screen ring and end termination having complimentary mating surfaces whereby when the end termination and component are engaged the complementary mating surfaces are in engagement and when the end termination and component are separated the mating surfaces disengage.

8. A device according to claim 7, wherein the complementary mating surfaces are respectively inclined surfaces of the end termination and screen ring.

9. An electrical cable according to claim 7, comprising a multi-core cable.

10. An electrical cable according to claim 8 connected to an electrical component comprising a multi-pin connector.

* * * * *